US007091925B1

(12) United States Patent
Wang

(10) Patent No.: US 7,091,925 B1
(45) Date of Patent: Aug. 15, 2006

(54) FLAT INDOOR UHF ANTENNA DEVICE FOR A DIGITAL TELEVISION

(75) Inventor: Cheng-Si Wang, Changhua Hsien (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 0 days.

(21) Appl. No.: 11/046,031

(22) Filed: Jan. 28, 2005

(51) Int. Cl.
*H01Q 7/00* (2006.01)

(52) U.S. Cl. ..... 343/866; 343/741

(58) Field of Classification Search ..... 343/866, 343/741, 860

See application file for complete search history.

(56) References Cited

U.S. PATENT DOCUMENTS 4,570,165 A * 2/1986 Tsurumaru et al. ..... 343/726
5,552,796 A * 9/1996 Diamond ..... 343/742
6,342,862 B1 * 1/2002 Schoenthal ..... 343/741
6,429,828 B1 * 8/2002 Tinaphong et al. ..... 343/824

* cited by examiner

*Primary Examiner*—Hoang V. Nguyen
(74) *Attorney, Agent, or Firm*—William E. Pelton, Esq.

(57) ABSTRACT

An indoor UHF antenna device for a digital television includes a flat structural design. The flat indoor UHF antenna device includes a circuit board having a wireless signal processing circuit and an antenna. A metal wire bent as a long rectangular antenna and having a gap forms the antenna. Two signal feeder points are defined at two locations having a same distance from two long sides of the long rectangular antenna respectively, and thereby the antenna includes a first antenna part having a gap and a second antenna part for impedance matching. The antenna is set horizontally on the circuit board with the signal feeder points welded on the circuit board. Thereby the antenna device of the present invention is enhanced to receive wireless signals of polarized waves transmitted by different transmitters.

10 Claims, 9 Drawing Sheets

FLAT INDOOR UHF ANTENNA DEVICE FOR A DIGITAL TELEVISION

BACKGROUND OF THE INVENTION

1. Field of the Invention

The invention relates in general to an indoor UHF antenna device for a digital television, and more particularly to a flat antenna device, which can be set conveniently without occupying too much space and is easy to be adjusted to different angles to receive wireless digital television signals of polarized waves from different directions.

2. Description of the Related Art

Referring to FIG. 8, a conventional digital antenna 50 for receiving digital television signals is shown. The digital antenna 50 includes a base 51 and a rod body 53 supported by the base 51. The rod body 53 is a telescopic antenna. When using the digital antenna 50, the base 51 is connected with an earth terminal of a television cable (not shown in the diagram), and the rod body 53 is connected to a signal input terminal of the television cable.

According to FIG. 8, it is clear that the digital antenna receives wireless signals in a direction perpendicular to the level. However, a conventional digital television transmitter generally includes horizontal polarized waves and vertical polarized waves. If it is desired to receive all kinds of optimal wireless signals from different transmitters, the receiving angle of the antenna requires appropriate adjustment. Take the antenna structure of FIG. 8 for example; the antenna can receive clear signals of the vertical polarized waves. If it is desired to receive clear signals of the horizontal polarized waves, the whole antenna must be put horizontal. Nevertheless, this kind of antenna is quite bulky and lacks a design for easy adjustment of the reception angles. Thereby the conventional antenna is not suitable to be adjusted to appropriate angles for receiving the signals.

Referring to FIG. 9, a structure diagram of a UHF indoor antenna 60 is shown. The UHF indoor antenna 60 mainly includes a baseboard 61, a substantially triangular antenna 62 with two ends, and a coaxial cable 63. Both ends of the triangular antenna 62 inset into the baseboard 61, and also are connected with an earth terminal and signal terminal (not shown in the diagram) of the coaxial cable 63. Comparing the UHF antenna 60 with the above-mentioned rod antenna 50, the size of the UHF antenna 60 is smaller, which is more convenient to be placed indoors. However, the triangular antenna 62 has to be connected perpendicularly with the baseboard 61, so that the size of the UHF antenna 60 cannot be further reduced. Therefore, the conventional indoor antennas still require further improving.

SUMMARY OF THE INVENTION

A flat indoor UHF antenna device for a digital television is provided with a structural design to make the whole set of the antenna device be able to become flat. Thereby the antenna device of the present invention is enhanced to receive wireless signals of horizontal polarized waves or vertical polarized waves transmitted by different transmitters.

According to an objective of the present invention, a flat indoor UHF antenna device mainly includes a circuit board and an antenna. The circuit board includes a wireless signal processing circuit and a connector for connecting with a coaxial cable. The antenna is formed by a metal wire bent as a long rectangular antenna having a gap. Two signal feeder points are respectively defined at two locations having a same distance from two long sides of the long rectangular antenna respectively, and thereby the antenna includes a first antenna part having a gap and a second antenna part for impedance matching. The antenna is set horizontally on the circuit board with the signal feeder points welded on the circuit board.

The antenna device appears as a flat structure by setting the long rectangular antenna on the circuit board horizontally, so as to effectively reduce a size of the antenna device. Therefore the present invention includes the advantages of being portable and compact.

DETAILED DESCRIPTION OF THE INVENTION

Figure 1:
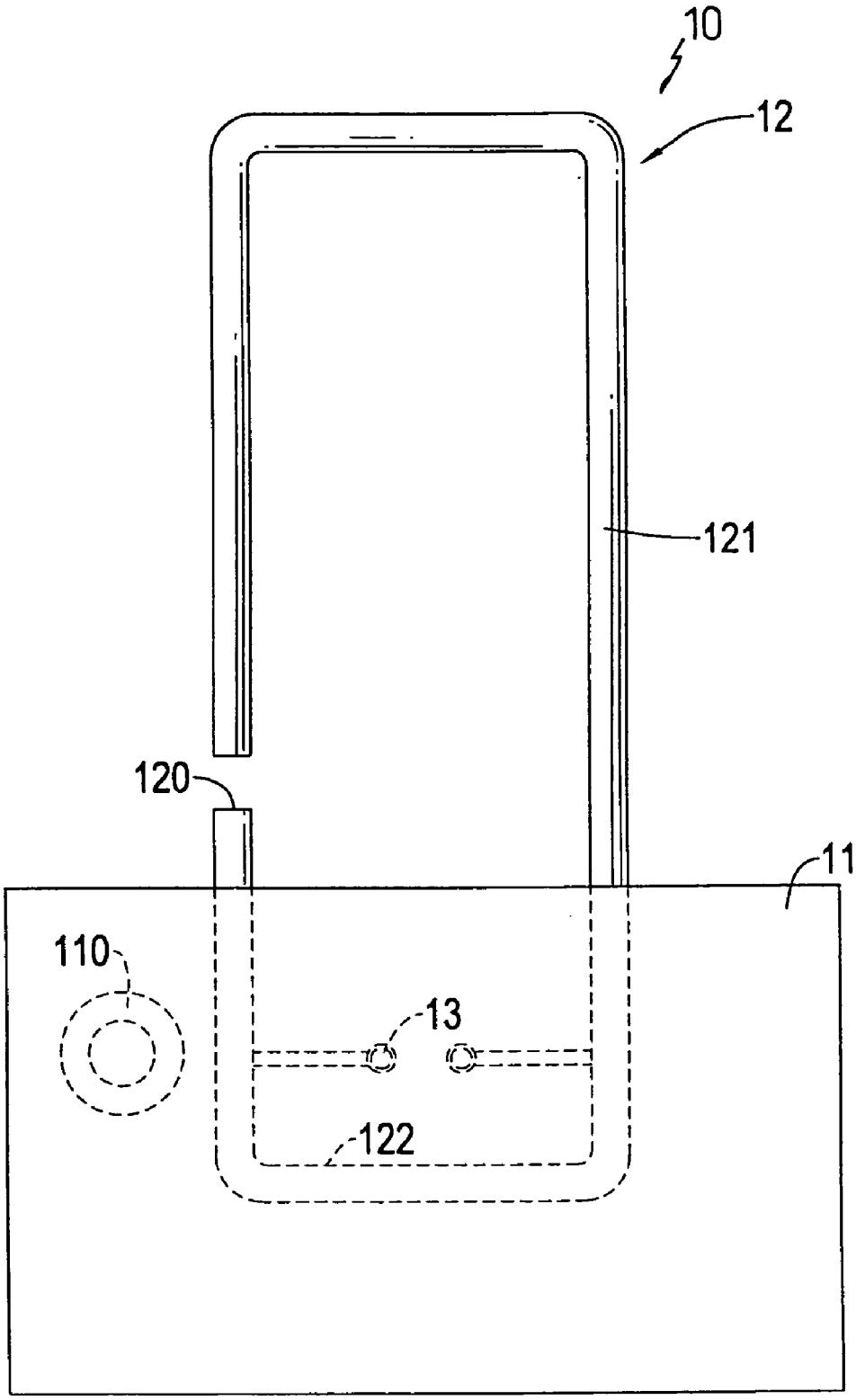
FIG. 1 is a front view of the present invention.

Referring to FIG. 1, a preferred embodiment of the present invention of an antenna device 10 for a digital television is shown. The antenna device 10 includes a circuit board 11 and an antenna 12. The circuit board 11 at least includes a wireless signal processing circuit (not shown in the diagram) and a connector 110 for connecting with a coaxial cable. The antenna 12 is formed by a metal wire bent as a substantially long rectangular antenna 12 having a gap 120. Two signal feeder points 13 are respectively defined at two locations having a same distance from two long sides of the long rectangular antenna 12 respectively, and thereby the antenna 12 includes a first antenna part 121 having a gap 120 and a second antenna part 122 for impedance matching. The antenna 12 is set horizontally on the circuit board 11 with the signal feeder points 13 welded on the circuit board 11.

The antenna device 10 appears a flat structure by setting the long rectangular antenna 12 on the circuit board 11 horizontally, so as to effectively reduce a size of the antenna device 10. Moreover, the present invention facilitate users to adjust receiving angles according to the type of the polarized waves, so as to clearly receive wireless digital television signals of designated transmitters.

Figure 2:
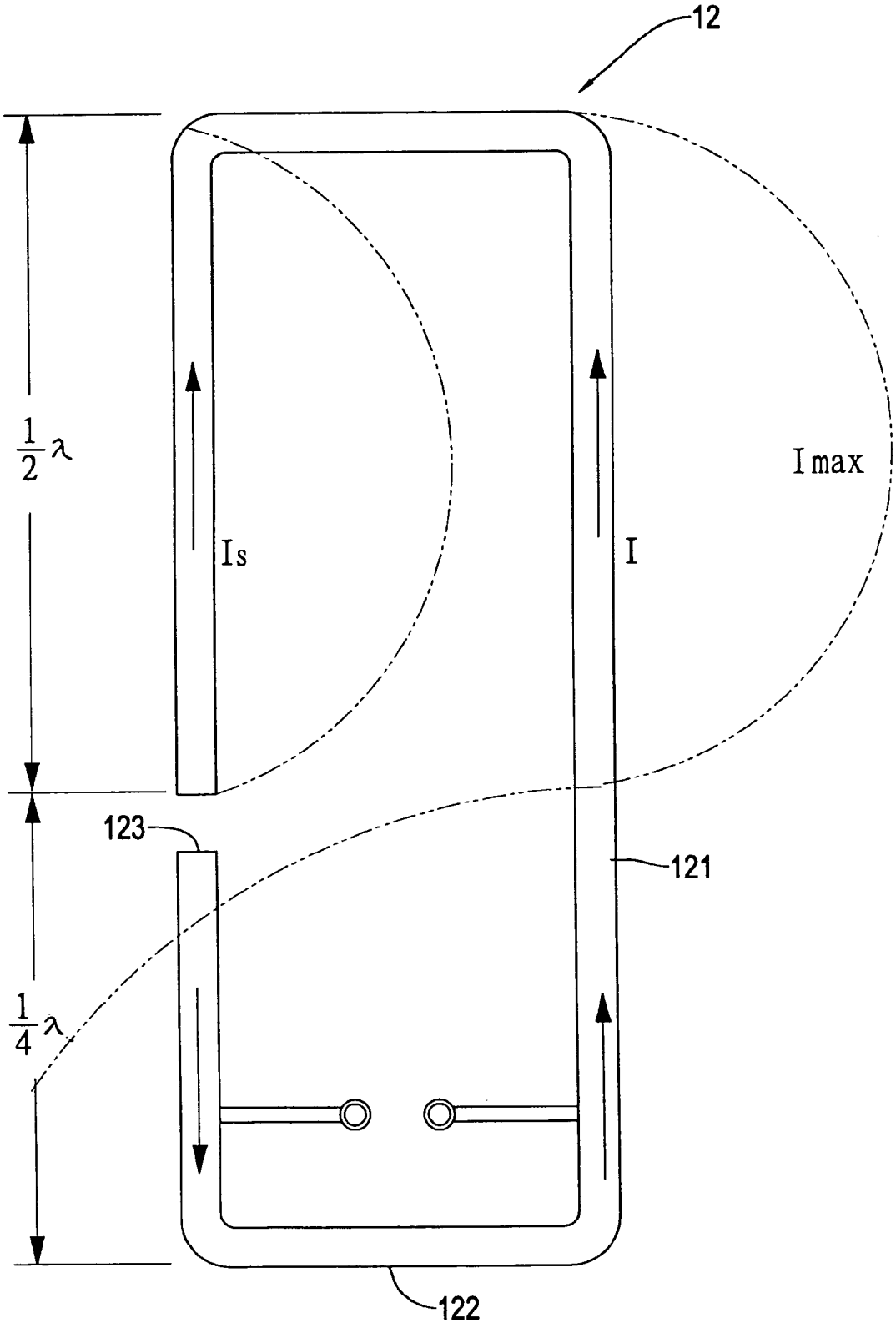
FIG. 2 is a waveform phase diagram of received signals of a long rectangular antenna of the present invention.

Further, the antenna 12 of the present invention includes an enhanced signal receiving function. Referring to FIG. 2, the antenna body is equivalent to an inductance. The gap 120 of the first antenna part 121 is equivalent to a capacitance, so as to make the received wireless signals of the first antenna part 121 generate a positive phase signal Is. As shown in the diagram, the positive phase signal Is makes the wireless signal I of a same phase originally enhanced due to an addition effect, so as to make the received wireless signal even much clearer. Besides, the second antenna part 122 of the antenna 12 provides a function of impedance matching for the signal feeder points 13 of the first antenna part 121. The impedance matching value can be determined by the signal feeder points 13 defined locations, so as to suit for wireless signal processing circuit of different input impedance and to reduce a loss of the signal strength. Thereby the present invention includes a feature of the flat structure and an advantage of enhancing the strength of the received signals.

Figure 3:
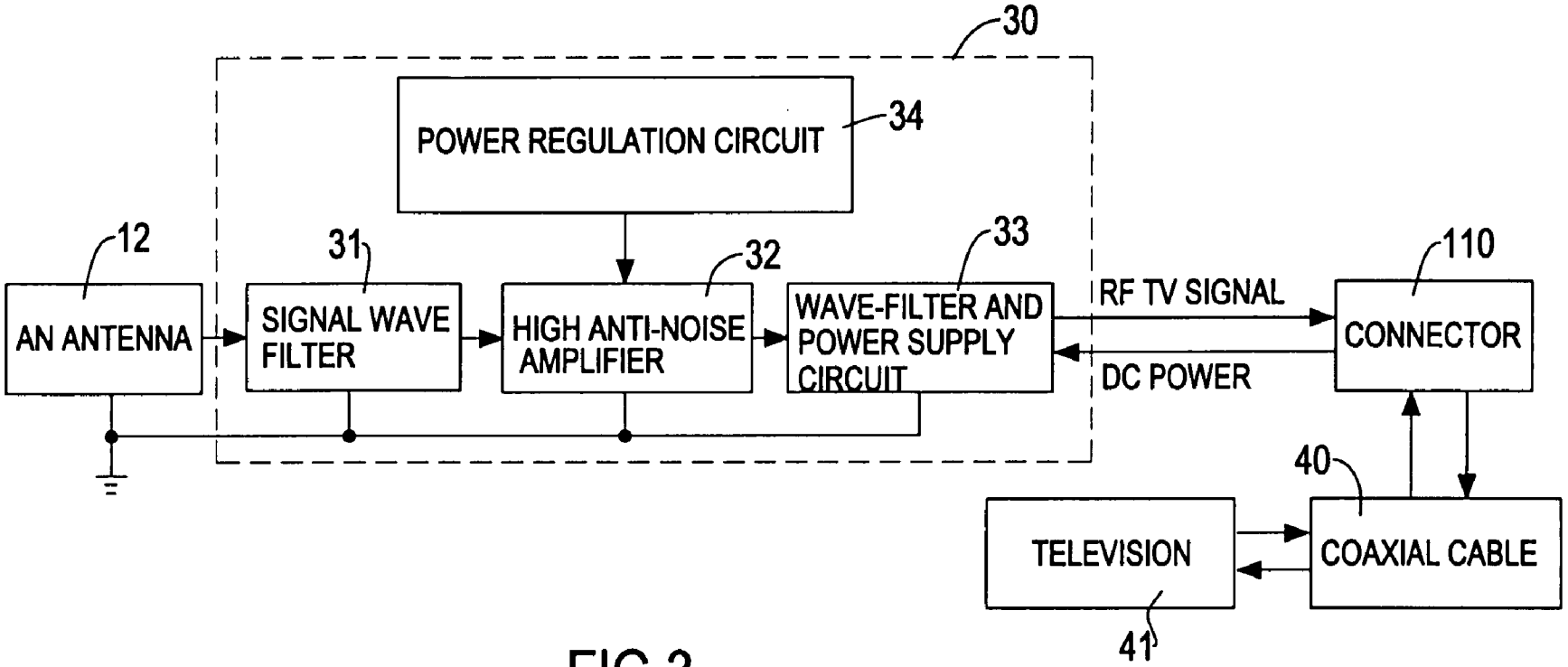
FIG. 3 is a block diagram of a wireless signal processing circuit of the present invention.
Figure 4:
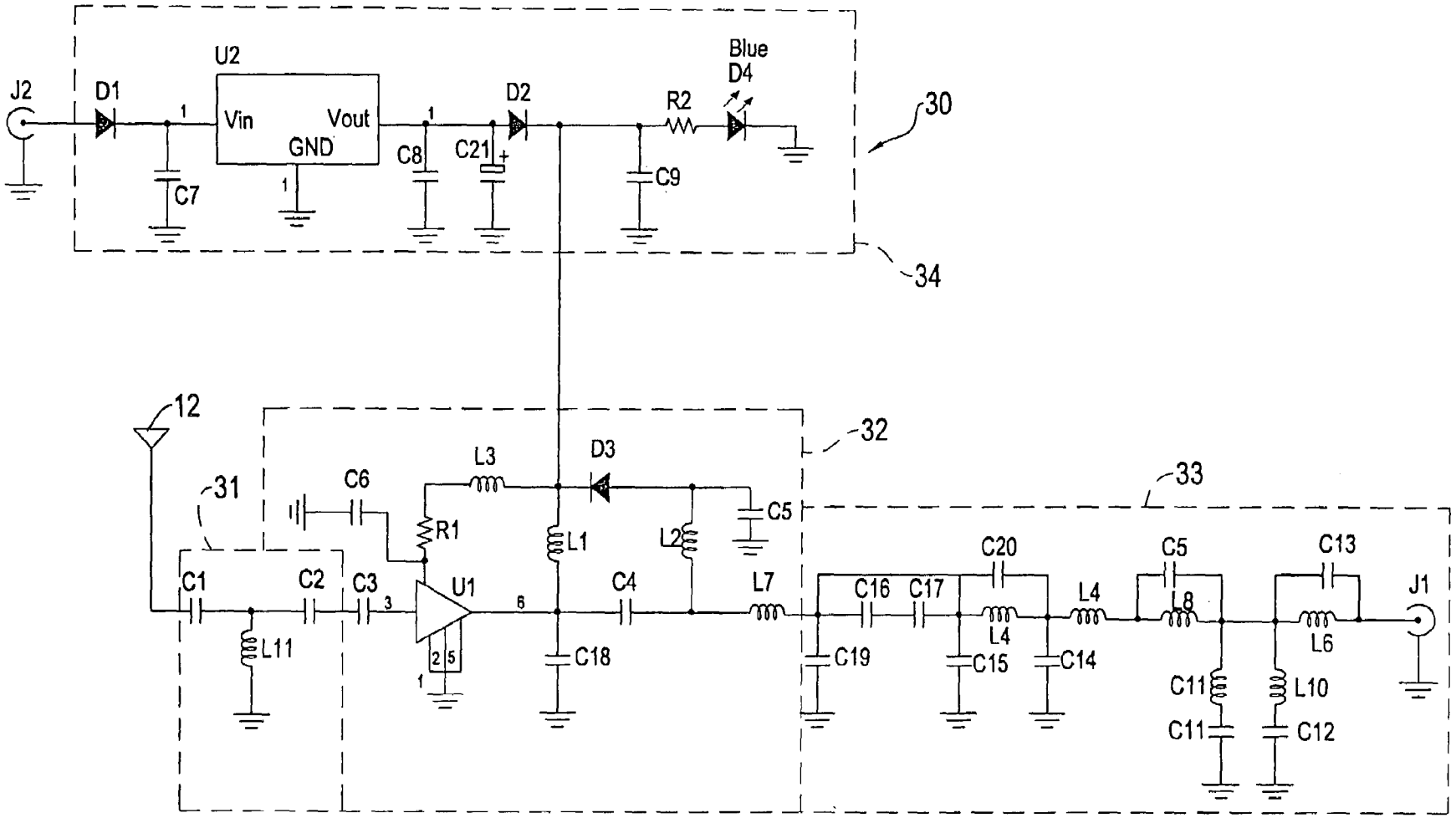
FIG. 4 is a detailed circuit diagram of FIG. 3.

Referring to FIG. 3 and FIG. 4, a preferred embodiment of an example of the present invention of a digital television signal processing circuit 30 is shown. Since the antenna device 10 of the present invention is for receiving the digital television signals, noise signals require processing to receive the genuine digital signals, so as to keep a clarity of television signals. Thereby the digital television signal processing circuit 30 of the present invention includes a signal wave filter 31, a high anti-noise amplifier 32, a wave-filter and power supply circuit 33, and a power regulation circuit 34. The signal wave filter 31 includes an input terminal connecting to a signal feeder terminal 13 of the long rectangular antenna 12 for capturing a wireless signal of a specific frequency band, which can receive the frequency band of 50 MHZ~870 MHZ. The high anti-noise amplifier 32 is connected to an output terminal of the signal wave filter 31 for filtering the noise of the wireless signal and then amplifies the signal and output. The wave-filter and power supply circuit 33 includes an input terminal connected to an output terminal of the high anti-noise amplifier 32, so as to filter the amplified wireless signal again, and to capture a digital television signal of a UHF frequency band, which is 470~870 MHZ. On the other hand, an output terminal of the wave-filter and power supply circuit 33 is connected to the connector 110 of the circuit 10. When the connector 110 is connected to a television via the coaxial cable 40, D.C. power is supplied to the connector 110. Further the wave-filter and power supply circuit 33 includes an inductance and a capacitance. Since the inductance is in a short circuit state under the D.C. power, thereby when the output terminal of the wave-filter and power supply circuit 33 is connected to the connector 110, the D.C. power is supplied to the high anti-noise amplifier 32 via the capacitance. The power regulation circuit 34 includes an input terminal connected to a D.C. power. The input D.C. power is then outputted to the high anti-noise amplifier 32 via a constant voltage regulator U2.

Figure 5:
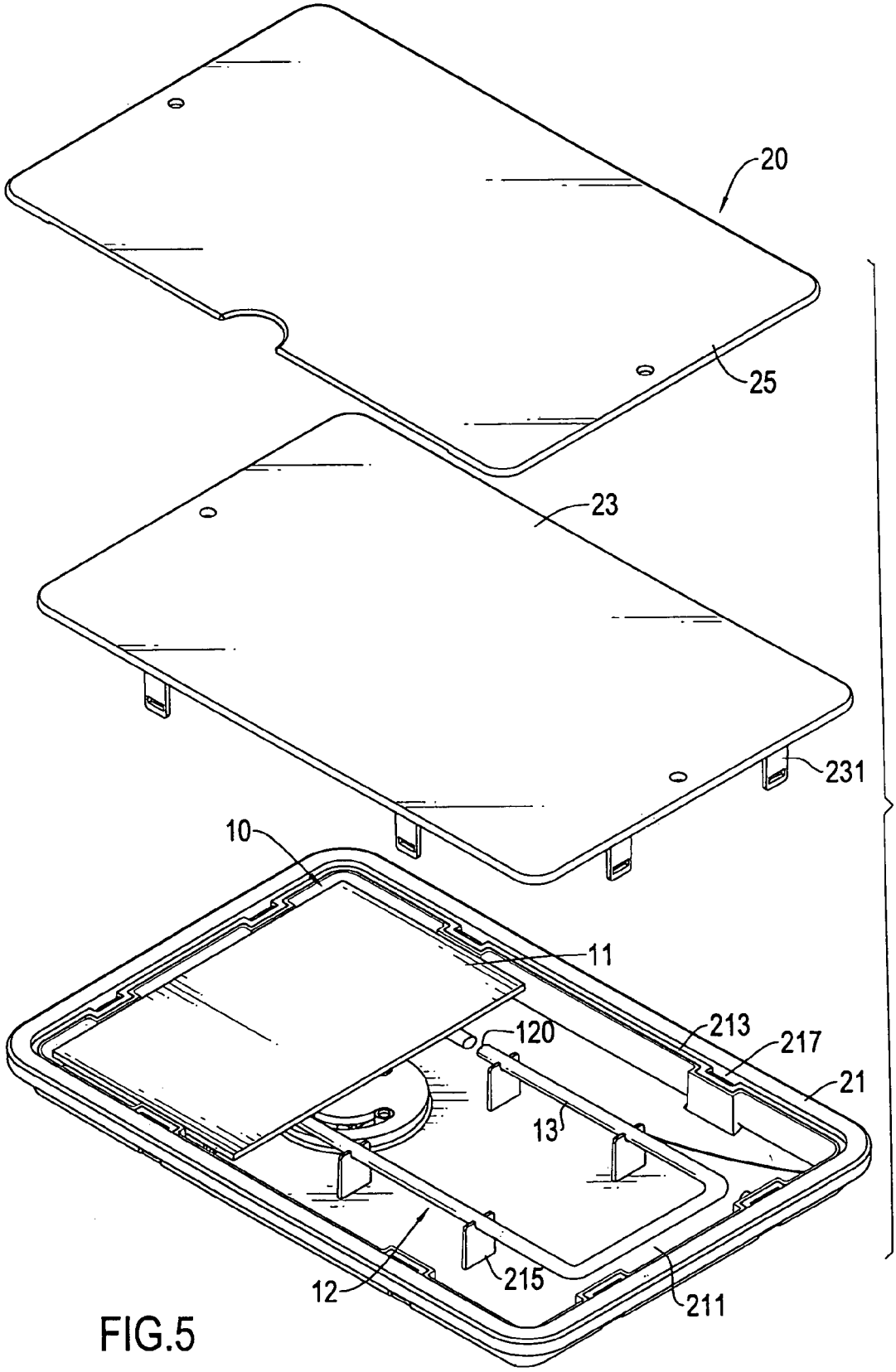
FIG. 5 is an exploded perspective view of an antenna device set inside a casing.

Still referring to FIG. 5, in order to help users adjust angles of the antenna device 10 of the present invention conveniently, the antenna device 10 can be place inside a casing 20. The casing 20 includes a base 21, a lid 23 and a plate 25. The base 21 includes a U-shaped cross-section. A plurality of upward mounts 215 is configured at a sunken bottom 211 of the base 21 for supporting the long rectangular antenna 12. The circuit board 11 is also stored inside the base 21. Besides, four sides of the base 21 form a ladder 213 at an inner part respectively, and a plurality of integrated troughs 217 is formed on the ladder 213. A plurality of integrated feet 231 are formed on an underside of the lid 23 and correspond to the integrated troughs 217 on the ladder 213 of the side of the base 21, so that the integrated feet 231 of the lid 23 can be integrated with the integrated troughs 217 on the ladder of the base 21. The plate 25 covers the lid 23 and also connects with the base 21 to stiffen the base 21.

When the antenna device 10 of the present invention is combined with the casing 20, the long rectangular antenna 12 is supported by the mounts 215, so as to fix and configure the antenna 12 inside the casing 20. Subsequently, the integrated feet 231 of the lid 23 plug in the corresponding integrated troughs 217, so as to integrate the lid 23 on the base 21. The plate 25 then covers the lid 23, and securing elements such as screws are used to fasten the plate 25 on the lid 23, so as to be stably integrated with the base 21.

Figure 6:
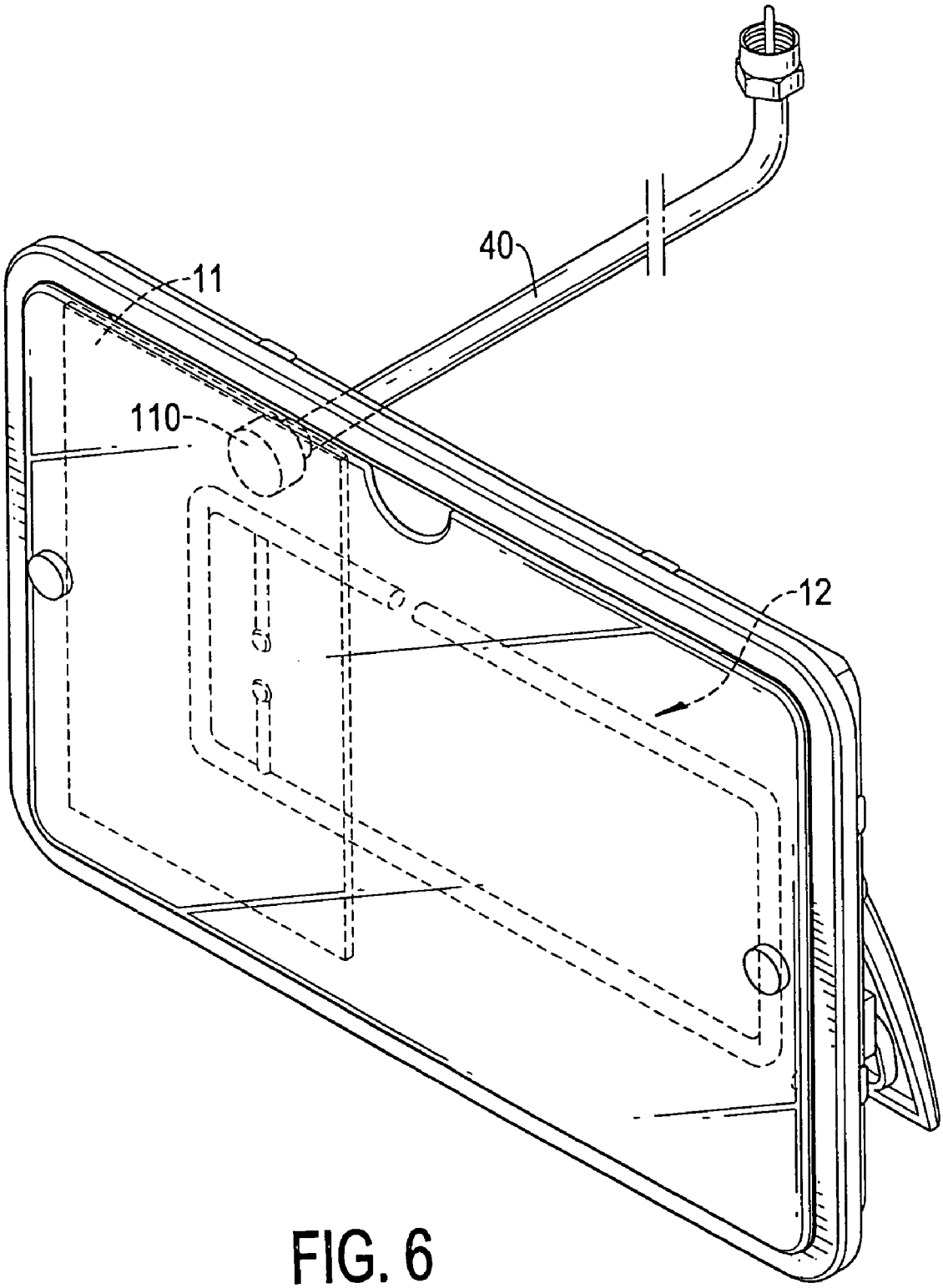
FIG. 6 is a side view of the present invention, wherein the antenna device and the casing of FIG. 5 are combined together with connecting to a coaxial cable.
Figure 7A:
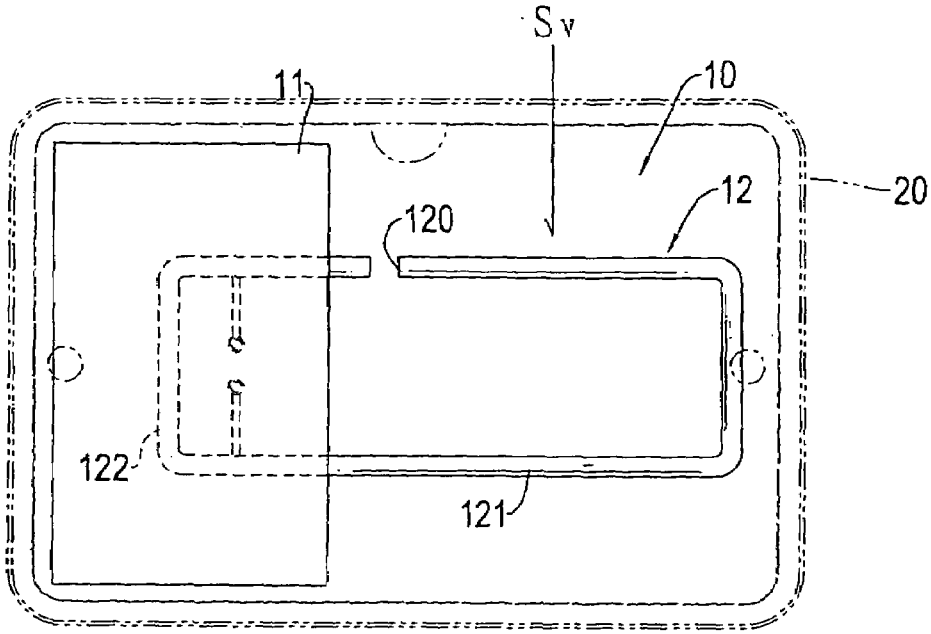
FIG. 7A and FIG. 7B show diagrams of the present invention when adjusting to different angles.
Figure 7B:
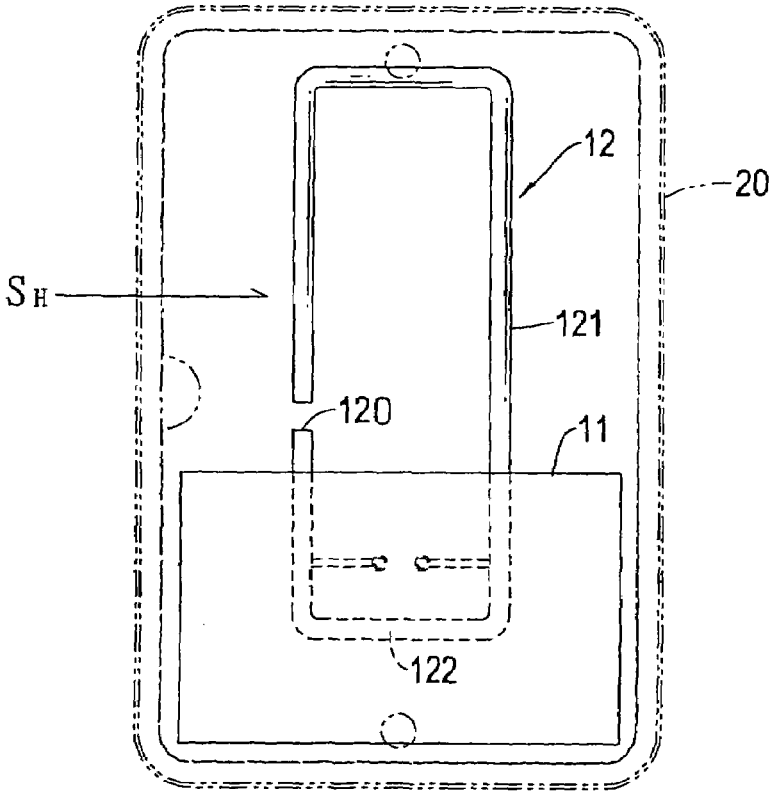
Figure 8:
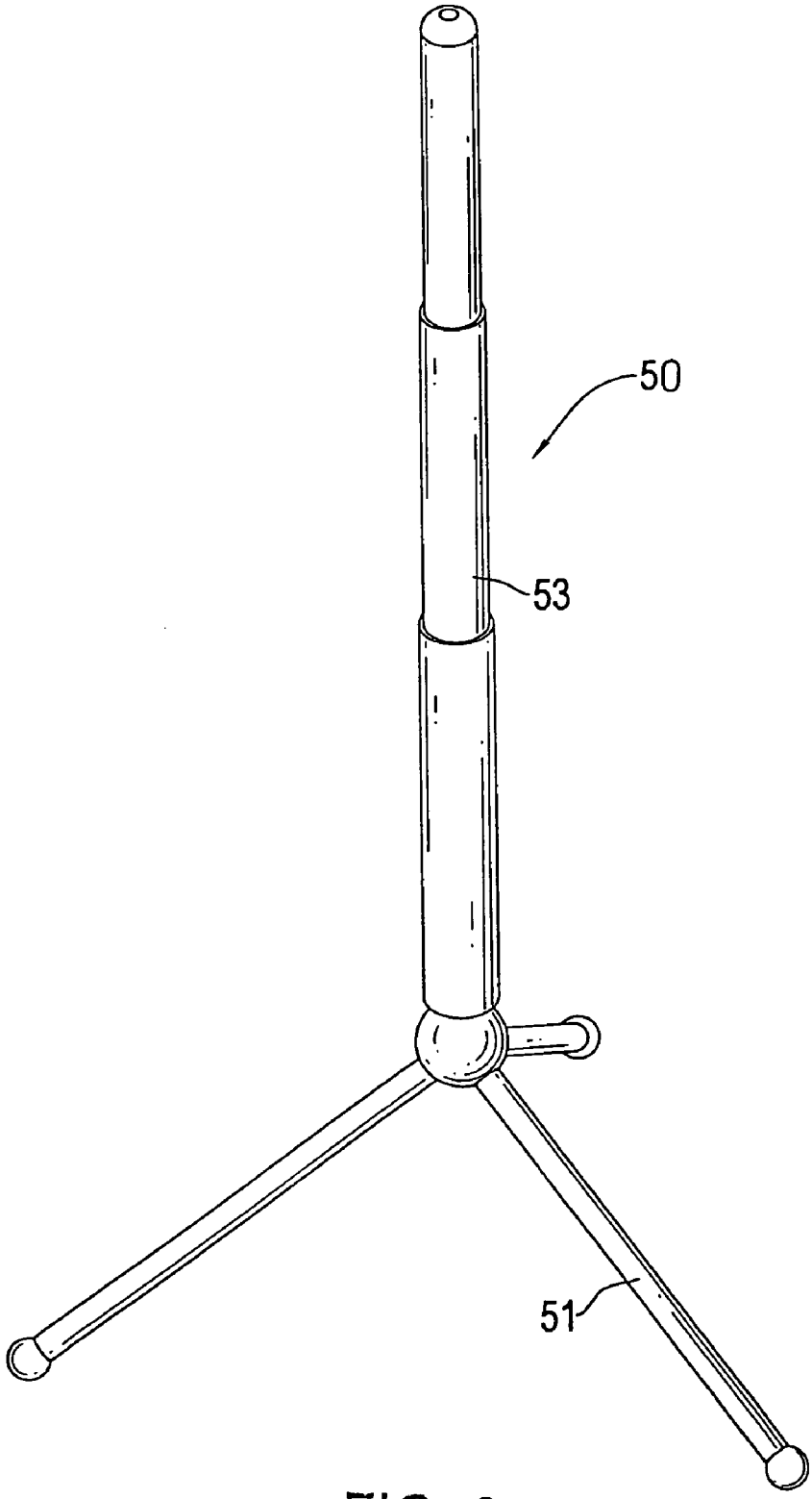
FIG. 8 PRIOR ART
FIG. 8 is a perspective view of a conventional antenna.
Figure 9:
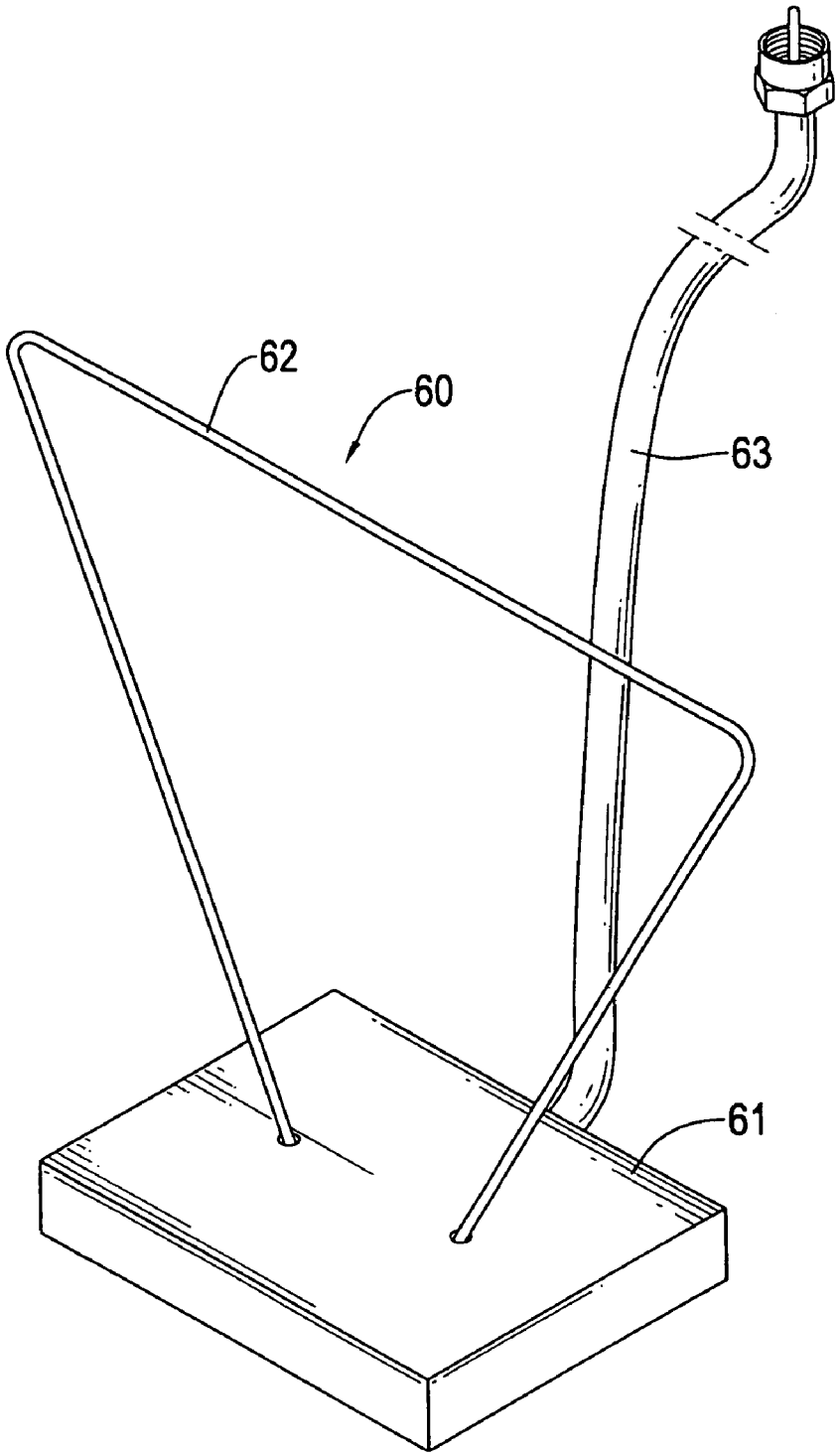
FIG. 9 PRIOR ART
FIG. 9 is another perspective view of a conventional antenna.

Referring to FIGS. 6, 7A and 7B, after the antenna device 10 in integrated with the casing 20, a back of the base 21 is configured with a bearing leg 219. The casing 20 can be set horizontally or vertically with the bearing leg 219 able to be pivoted. When the casing 20 is set horizontally, the long part of the long rectangular antenna 12 can receive the wireless signals of vertical polarized waves $S_V$, whereas the wireless signals of the horizontal polarized waves $S_H$ can be received when the casing 20 is set vertically. In this way, the antenna device 10 inside the casing 20 can be easily adjusted to receive signals of the horizontal polarized waves or vertical polarized waves from the transmitters.

Therefore an objective of the present invention is achieved by horizontally connecting the long rectangular antenna and the circuit, so as to make the whole antenna structure flat and not occupy too much space. Thereby the antenna device can be adjusted to any appropriate receiving angle easily, so as to match up receiving wireless digital television signals of the horizontal polarized waves or vertical polarized waves from different transmitters. In addition, the antenna device of the present invention also can receive circularly polarized waves despite such waves having a receiving strength much weaker than the horizontal polarized waves or vertical polarized waves. Moreover, most important of all, the present invention makes good use of the formation locations of the signal feeder points and the gap, so as to make the long rectangular antenna include the first antenna part for enhancing the strength of the received signal and the second antenna part for the impedance matching. Hence the present invention of the antenna device includes the features of the high receiving strength.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flat indoor UHF antenna device for a digital television comprising:

a circuit board mainly comprising a wireless signal processing circuit and a connector for connecting with a coaxial cable;

an antenna which is formed by a metal wire formed as a long rectangular antenna having a gap, wherein two signal feeder points are defined at two locations having a same distance from two long sides of the long rectangular antenna respectively, and thereby the antenna comprising a first antenna part having a gap and a second antenna part for impedance matching, and wherein the antenna is set horizontally on the circuit board with the signal feeder points welded on the circuit board.

2. The flat indoor UHF antenna device for the digital television as defined in claim 1, wherein the digital television signal processing circuit comprises:

a signal wave filter with an input terminal connecting to a signal feeder terminal of the long rectangular antenna for capturing a wireless signal of a specific frequency band;

a high anti-noise amplifier connected to an output terminal of the signal wave filter for filtering the noise of the wireless signal and then amplifying the signal and output;

a wave-filter and power supply circuit wherein an input terminal is connected to an output terminal of the high anti-noise amplifier, so as to filter the amplified wireless signal again, and to capture a digital television signal of a UHF frequency band, wherein an output terminal is connected to the TV connector of the circuit, wherein when the TV connector is connected to a television via the coaxial cable, a D.C. power supply to the connector begins, and further the wave-filter and power supply circuit comprises an inductance and a capacitance, thereby when the output terminal of the wave-filter and power supply circuit is connected to the TV connector, the D.C. power is supplied to the high anti-noise amplifier via the capacitance; and a power regulation circuit wherein an input terminal is connected to a D.C. power supply, wherein the input D.C. power supply is outputted to the high anti-noise amplifier via a constant voltage regulator.

3. The flat indoor UHF antenna device for the digital television as defined in claim 2, wherein the flat indoor UHF antenna device is placed inside a casing, wherein the casing comprises:

a base comprising a U-shaped cross-section for receiving the circuit board and the long rectangular antenna;

a lid for covering an opening of the base, and also for covering the circuit board and the long rectangular antenna; and a plate for covering the lid and also reinforcing the base.

4. The flat indoor UHF antenna device for the digital television as defined in claim 3, wherein a plurality of upward mounts are configured at a bottom of the base for supporting the long rectangular antenna.

5. The flat indoor UHF antenna device for the digital television as defined in claim 4, wherein a downward sunken ladder is formed at an inner part of a side upper face of the base, and wherein a plurality of integrated troughs are formed on the ladder, wherein a plurality of integrated feet are formed on an underside of the lid corresponding to the integrated troughs on the side of the base, so that the lid can be integrated with the ladder of the base.

6. The flat indoor UHF antenna device for the digital television as defined in claim 3, wherein a back of the base is configured with a bearing leg.

7. The flat indoor UHF antenna device for the digital television as defined in claim 1, wherein the flat indoor UHF antenna device is placed inside a casing, wherein the casing comprises:

a base comprising a U-shaped cross-section for receiving the circuit board and the long rectangular antenna;

a lid for covering an opening of the base, and also for covering the circuit board and the long rectangular antenna; and a plate covering the lid and reinforcing the base.

8. The flat indoor UHF antenna device for the digital television as defined in claim 7, wherein a plurality of upward mounts are configured at a bottom of the base for supporting the long rectangular antenna.

9. The flat indoor UHF antenna device for the digital television as defined in claim 8, wherein a downward sunken ladder is formed at an inner part of a side upper face of the base, and wherein a plurality of integrated troughs are formed on the ladder, wherein a plurality of integrated feet are formed on an underside of the lid corresponding to the integrated troughs on the side of the base, so that the lid can be integrated with the ladder of the base.

10. The flat indoor UHF antenna device for the digital television as defined in claim 7, wherein a back of the base is configured with a bearing leg.

* * * * *